US008337631B2

(12) United States Patent
Brown-West et al.

(10) Patent No.: US 8,337,631 B2
(45) Date of Patent: Dec. 25, 2012

(54) DISHWASHER WITH SEPARATE SUMP FOR CONCENTRATED FLUID SUPPLY

(75) Inventors: Boma M. Brown-West, Somerville, MA (US); Kristopher L. Delgado, Stevensville, MI (US); Janice M. Kaeding, Lawrence, MI (US); Jamie M. McQueen, Overland Park, KS (US); Sathish A. Sundaram, Benton Harbor, MI (US); Tremitchel Wright, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 243 days.

(21) Appl. No.: 12/719,141

(22) Filed: Mar. 8, 2010

(65) Prior Publication Data

US 2011/0214695 A1 Sep. 8, 2011

(51) Int. Cl.
*B08B 9/20* (2006.01)

(52) U.S. Cl. ..... 134/25.2

(58) Field of Classification Search ..... None
See application file for complete search history.

(56) References Cited

U.S. PATENT DOCUMENTS

| | | | | |
|---|---|---|---|---|
| 5,131,419 | A | 7/1992 | Roberts | |
| 5,184,635 | A | 2/1993 | Tromblee et al. | |
| 5,223,042 | A | 6/1993 | Milocco | |
| 5,264,043 | A | 11/1993 | Milocco | |
| 5,331,986 | A | 7/1994 | Lim et al. | |
| 5,427,127 | A | 6/1995 | Nogi et al. | |
| 5,494,062 | A | 2/1996 | Springer | |
| 5,545,259 | A | 8/1996 | Suzuki et al. | |
| 5,669,983 | A | 9/1997 | Cooper et al. | |
| 5,704,380 | A | 1/1998 | Zelniker et al. | |
| 5,849,101 | A | 12/1998 | Edwards et al. | |
| 6,244,277 | B1 | 6/2001 | Maunsell | |
| 6,432,216 | B1 | 8/2002 | Thies | |
| 7,195,023 | B2 | 3/2007 | McKee et al. | |
| 7,232,494 | B2 | 6/2007 | Rappette | |
| 7,255,113 | B2 | 8/2007 | Elick et al. | |
| 7,337,790 | B2 | 3/2008 | Ha | |
| 7,387,688 | B2 | 6/2008 | Jung et al. | |
| 7,475,696 | B2 | 1/2009 | Vanderroest et al. | |
| 7,493,907 | B2 | 2/2009 | Roh | |
| 2004/0118435 | A1 | 6/2004 | Jung et al. | |
| 2006/0042658 | A1 | 3/2006 | Engler | |
| 2006/0096615 | A1 | 5/2006 | Elick et al. | |
| 2006/0111260 | A1 | 5/2006 | Peterson et al. | |
| 2006/0137716 | A1 | 6/2006 | Gault | |
| 2007/0034234 | A1 * | 2/2007 | Holzman et al. | 134/10 |
| 2007/0181154 | A1 | 8/2007 | Beer et al. | |
| 2007/0251549 | A1 * | 11/2007 | Heiligenmann et al. | 134/31 |
| 2007/0295361 | A1 | 12/2007 | Thiyagarajan et al. | |
| 2008/0276965 | A1 | 11/2008 | Aykroyd et al. | |
| 2009/0032061 | A1 | 2/2009 | Beer et al. | |
| 2009/0038644 | A1 | 2/2009 | Fauth et al. | |
| 2009/0159097 | A1 * | 6/2009 | Berner et al. | 134/10 |

* cited by examiner

*Primary Examiner* — Michael Kornakov
*Assistant Examiner* — Nicole Blain
(74) *Attorney, Agent, or Firm* — Jacquelyn R. Lin; Diederiks & Whitelaw PLC

(57) ABSTRACT

A dishwasher includes a main sump that holds the main wash fluid supply, and a separate sump formed in the bottom wall of the tub away from the main sump. The separate sump holds a concentrated wash fluid supply. The separate sump supplies wash fluid for washing periods in which a highly concentrated chemistry mixture is desired.

20 Claims, 5 Drawing Sheets

DISHWASHER WITH SEPARATE SUMP FOR CONCENTRATED FLUID SUPPLY

TECHNICAL FIELD

The present disclosure relates generally to domestic dishwashers, and more particularly to a dishwasher that has a separate sump for a concentrated fluid supply.

BACKGROUND

A dishwasher machine is a domestic appliance into which dishes and other cooking and eating wares (e.g., plates, bowls, glasses, flatware, pots, pans, bowls, etcetera) are placed to be washed. During a wash cycle, a sump in the bottom of the dishwasher tub fills with water. A heating element inside the tub heats the water. Detergent released from a dispenser mixes with the heated water. Sprayers circulate the water and detergent mixture over the dishes. The wash cycle is followed by a rinse cycle, in which the sprayers circulate clean water over the dishes. At the end of each cycle, the used liquid is drained from the tub.

Some dishwashers have multiple washing and rinsing periods within a complete wash cycle. For example, some dishwashers provide washing periods in which wash liquid is directed to a specific area of the tub, such as an area where heavily soiled pots and dishes tend to be located.

SUMMARY

According to one aspect, a dishwashing method performed by a dishwashing machine includes directing fluid into a first sump located in a bottom wall of a tub of the dishwashing machine, directing wash fluid from the first sump to a spray system located in the tub, directing a second volume of fluid into a second sump located in the bottom wall of the tub and spaced from the first sump, creating a concentrated wash fluid in the second sump, where the concentrated wash fluid has a higher wash chemistry concentration than the wash fluid from the first sump, and directing the concentrated wash fluid to the spray system.

The method may include draining the concentrated wash fluid from the tub, or recirculating the concentrated wash fluid to the spray system. Further, the method may include directing the wash fluid from the first sump to a first sprayer of the spray system and directing the concentrated wash fluid from the second sump to a second sprayer of the spray system.

The method may include selectively directing fluid from one of the first and second sumps to the other of the first and second sumps through a communication chamber located underneath the tub. The method may include closing a lid to cover the second sump. Further, the method may include sensing the concentration of wash chemistry in the second sump and sending an output signal indicative of the sensed wash chemistry concentration to an electronic control unit of the dishwashing machine.

According to another aspect of this disclosure, a dishwashing method performed by a dishwashing machine includes directing a first volume of fluid into a first sump located in a bottom wall of a tub of the dishwashing machine, directing wash fluid from the first sump to a first fluid delivery device located in the tub, directing a second volume of fluid into a second sump located in the bottom wall of the tub and spaced from the first sump, creating a concentrated wash fluid in the second sump, the concentrated wash fluid having a higher wash chemistry concentration than the wash fluid in the first sump, and directing the concentrated wash fluid to a second fluid delivery device.

The method may include activating a wash chemistry activation device located in the second sump. The method may include receiving fluid from the first sump into the second sump. The method may include receiving fluid from a fluid supply located outside the tub into the second sump. The method may include releasing a gas into the second sump.

The method may include activating an indicator on the dishwashing machine, where the indicator indicates a status of the second sump. The method may include directing by the second fluid delivery device the concentrated wash fluid to a wash area in the tub. The method may include activating at least one of a foamer, nebulizer, fan, sprayer, mister, and injector.

The method may include opening a lid of the second sump. The method may include selectively opening and closing by an electronic control unit a lid of the second sump. The method may include selectively opening and closing a valve coupled to the second sump. The method may include sensing the concentration of wash chemistry in the second sump and sending an output signal indicative of the sensed wash chemistry concentration to an electronic control unit of the dishwashing machine.

BRIEF DESCRIPTION OF THE DRAWINGS

The detailed description particularly refers to the following figures, in which.

DETAILED DESCRIPTION OF THE DRAWINGS

Figure 1:
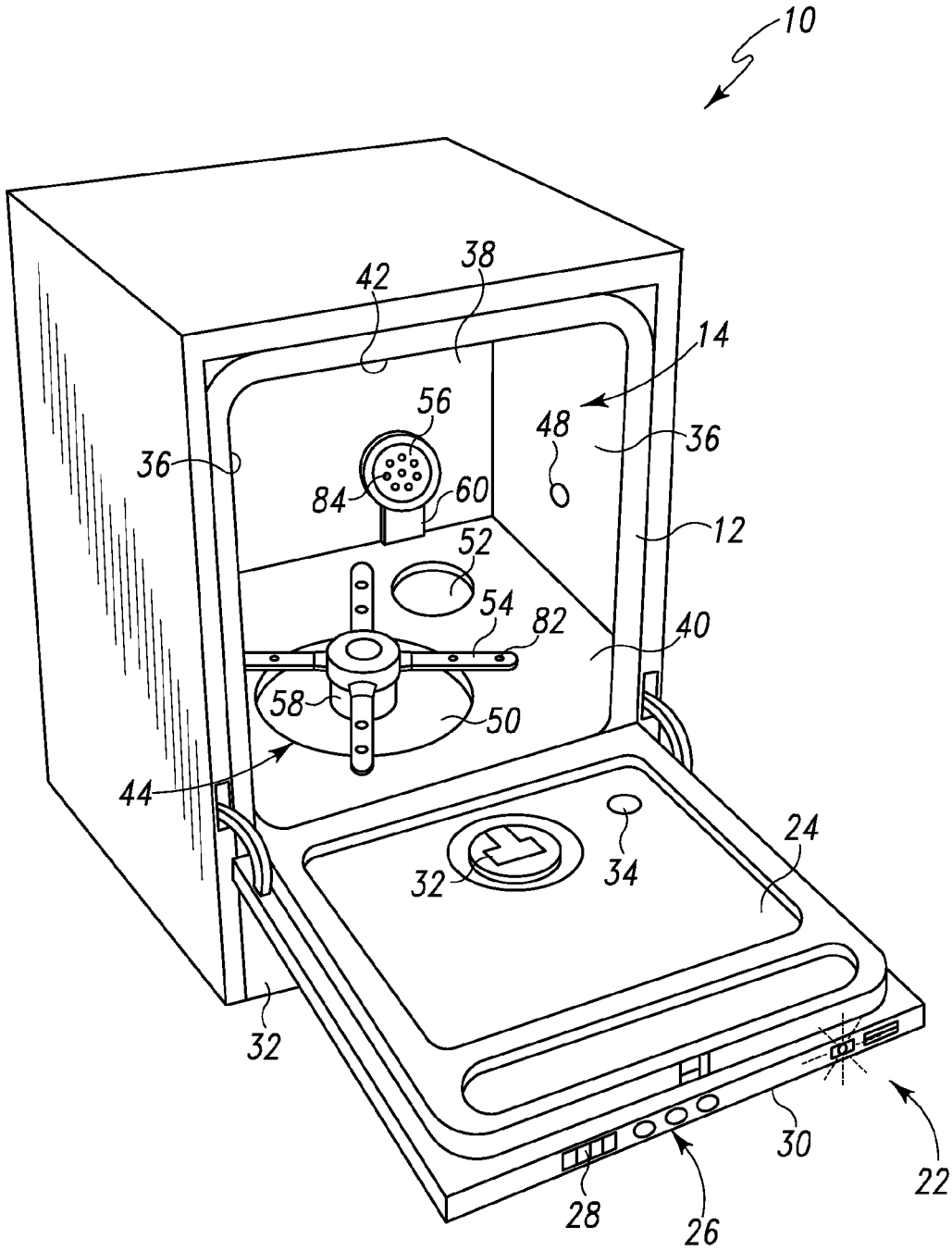
FIG. 1 is a perspective view of a dishwasher.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwasher 10 is shown. The dishwasher 10 has a tub 12 that defines a wash chamber 14 into which a user may place dishes and other cooking and eating wares (e.g., plates, bowls, glasses, flatware, pots, pans, bowls, utensils, etc.) to be washed.

Figure 2:
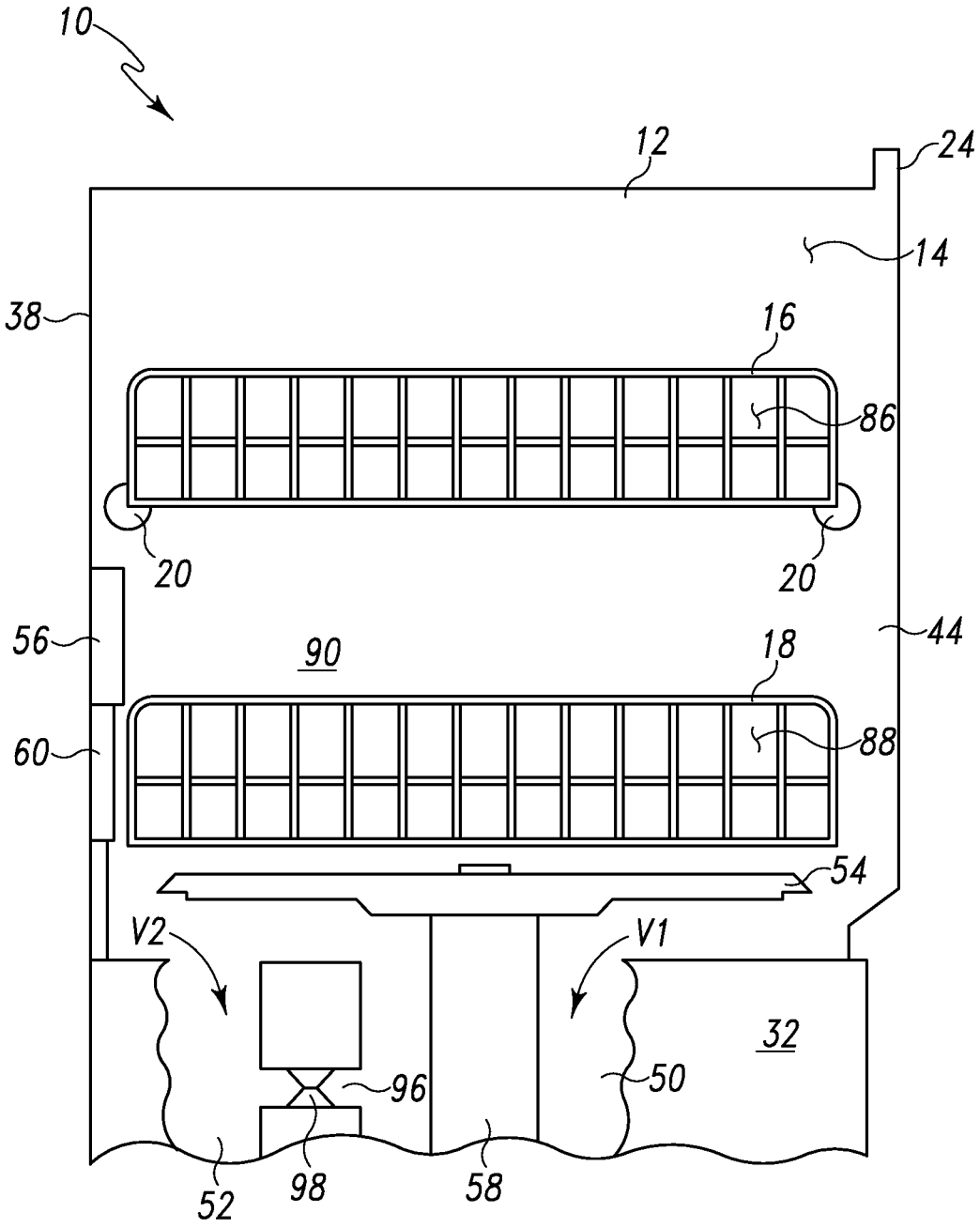
FIG. 2 is a fragmentary schematic side cross-sectional view of the dishwasher of FIG. 1.

As shown schematically in FIG. 2, the dishwasher 10 includes a number of racks 16, 18 located in the tub 12. Upper and lower dish racks 16, 18 are shown, although other dish racks may also be included in the dishwasher 10. A number of roller assemblies 20 allow the dish racks 16, 18 to move into and out of the tub 12, which facilitates the loading and unloading of the dish racks 16. The roller assemblies supporting the lower dish rack 18 are omitted from the drawings for clarity.

A door 24 is hinged to the lower front edge of the tub 12. As shown in FIG. 1, the door 24 permits user access to an open front side 44 of the tub 12 to add wash chemistry (e.g. detergent or rinse aid) to either or both of the dispensers 32, 34, load and unload the dish racks 16, 18, or perform other tasks. When closed, the door 24 seals the wash chamber 14.

A control panel 26 is supported by the door 24. The control panel 26 includes a number of controls 28, such as buttons or knobs, which enable a user to activate or deactivate a wash cycle of the dishwasher 10, or to perform other functions. The control panel 26 may also include one or more indicators 22, which communicate a status of a component or feature of the dishwasher, or other information, to the user. For example, one of the indicators 22 may be illuminated when the dishwasher or a feature thereof (e.g., a pre-treating feature) is activated and not illuminated when the feature is not activated, or vice versa. Another of the indicators 22 may include a number of illuminatable sections, such that the section or sections that are illuminated relative to the whole indicates a status of a component of the dishwasher (e.g. a sump or dispenser being full, partially full, or empty). A handle 30 facilitates opening and closing of the door 24.

The tub 12 includes a bottom wall 40 and a top wall 42. A back wall 38 and a pair of side walls 36 extend upwardly from the bottom wall 40 to the top wall 42 to define the wash chamber 14.

Inside the wash chamber 14, the bottom wall 40 of the tub 12 has a pair of sumps 50, 52 formed (e.g. stamped) therein. Each of the sumps 50, 52 defines a reservoir that extends downwardly in a direction away from the bottom wall 40 of the tub 12. Each of the reservoirs holds a volume of wash fluid. The size of the reservoir defined by the sump 52 is smaller than the size of the reservoir defined by the sump 50. Thus, the sump 52 holds a smaller volume of wash fluid than does the sump 50.

The dishwasher 10 has a spray system that includes a number of sprayers 54, 56 positioned in the wash chamber 14. The spray system may include other sprayers, spray arms, or fluid delivery devices, alternatively or in addition to those shown and described herein.

At the start of a wash cycle, water enters the wash chamber 14 through an inlet 48. Portions of the bottom wall 40 of the tub 12 may be shaped (e.g. ridged, channeled or sloped downwardly) so that water is directed toward one or both of the sumps 50, 52 by the force of gravity.

Figure 3:
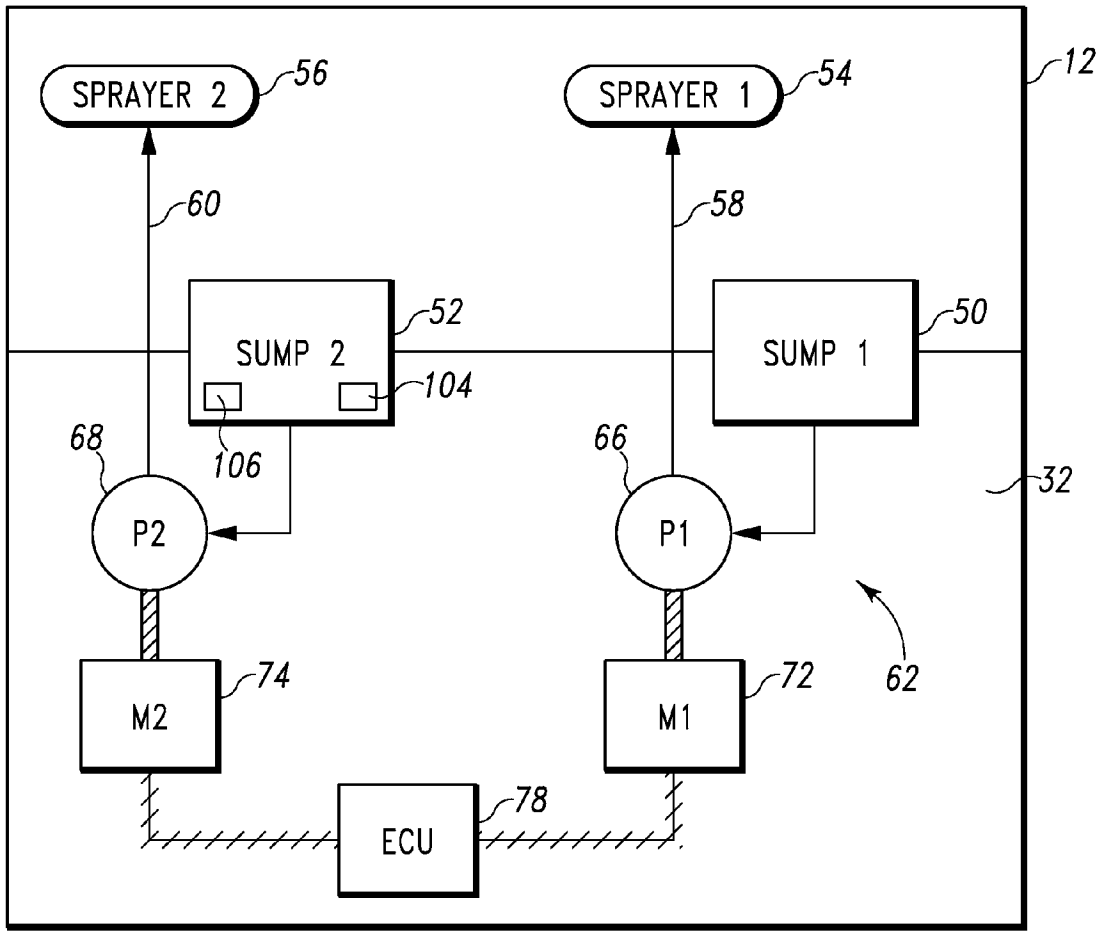
FIG. 3 is a schematic showing components of one embodiment of a sump assembly for the dishwasher of FIG. 1.

Wash chemistry is released at the appropriate time from the dispensers 32, 34. Referring to FIG. 3, the dispensed wash chemistry mixes with water in the sump or sumps 50, 52. A pump assembly 62 draws the wash fluid (e.g. the wash chemistry and water mixture) from the sump or sumps 50, 52 and directs it to the sprayer or sprayers 54, 56. The pump assembly 62 includes pumps 66, 68, which are driven by motors 72, 74 in response to control signals received by the motors 72, 74 from an electronic control unit 78.

Typically, wash chemistry released from the dispenser 32 mixes with fluid in the sump 50. At the appropriate time (e.g., the beginning of a "normal" wash cycle), the pump 66 draws the wash fluid from the sump 50 and directs it to the sprayer 54 through a supply tube 58. The sprayer 54 directs the wash fluid through outlets 82 toward a wash area defined by the sprayed wash fluid. As illustrated, the sprayer 54 is a rotating spray arm that sprays wash fluid in an upward direction toward the dish racks 16, 18. As such, the wash area covered by the sprayer 54 typically includes the wash areas 88 and 90, and may also include portions of the wash area 86.

At the same time, or during another portion of the wash cycle (e.g. a pre-treating or post-treating phase), wash chemistry is released from the dispenser 34 and mixed with fluid in the sump 52. As illustrated, the dispenser 34 is mounted in the door 24 of the dishwasher 10. Alternatively, the dispenser 34 may be integrated into the sump 52 (i.e., as an open or closed cup, a cartridge receptacle, or the like). As another alternative, or in addition, wash chemistry released from the dispenser 32 could be mixed with fluid in the sump 52 at the appropriate time during the wash cycle, in which case, the dispenser 34 may be omitted.

In the sump 52, the wash chemistry mixes with a relatively small volume of water. In one example, the volume V2 of the sump 52 is at least one-third smaller than the volume V1 of the sump 50. In this example, the volume V2 is in the range of about one liter, while the volume V1 is in the range of about three to seven liters or more. In other versions, the volume V2 may be in the range of about 20 milliliters up to about 200 milliliters or up to about 2.5 liters. As a result, a highly concentrated wash fluid is created in the sump 52. For example, the sump 52 may provide a concentrated wash fluid in the range of about two to about five times that of the sump 50. In many instances, the concentrated wash fluid is a concentrated detergent and water mixture. However, the concentrated wash fluid could include a gas, vapor, fog, liquid (e.g. aqueous, non-aqueous polar, non-aqueous nonpolar), gel, or the like, or a combination of any of these. The sump 52 could also be used to create a concentrated rinsing agent rather than a concentrated cleaning agent. It is contemplated that any chemical composition suitable for use in the apparatus and methods described herein may be incorporated into the wash fluid.

The pump assembly 62 draws the concentrated wash fluid from the sump 52 and directs it to the sprayer 56 through a supply tube 60. The sprayer 56 directs the concentrated wash fluid through outlets 56 outwardly toward the wash area 90. The wash area 90 typically includes a portion of the wash area 88, but may include portions of the wash area 86. For instance, the wash area 90 could include a utensil basket or a stemware rack. As illustrated, the wash area 90 is smaller than the wash areas 86, 88, but this need not be the case. Regardless of the size of the wash area 90, the chemical action of the concentrated wash fluid aids the mechanical action of the sprayer 56. The combined action may be useful in removing tough stains or baked-on soils from glasses, pots, dishes or other wares located in the wash area 90.

In the illustration of FIG. 2, the sprayer 56 is a vertically-oriented nozzle-type sprayer that is fixed to the back wall 38 of the tub 12. Typically, the sprayer 56 outputs wash fluid at a higher pressure than does the sprayer 54. However, the sprayer 56 may be a rotating spray arm similar to the sprayer 54. For example, the sprayer 56 could be positioned to rotate above the lower dish rack 18 or to rotate above the upper dish rack 16. Also, the sprayer 56 could have a spray manifold that includes multiple spray heads.

Once the concentrated wash fluid is delivered to the wash area 90, it may be drained from the tub 12 by an outlet (not shown), or recirculated to the wash area 90 by the sump 52, the pump assembly 62, and the sprayer 56. The electronic control unit 78, 80, 108 sends electrical signals to the pump assembly 62, 64, 120 to control whether the wash cycle includes one or multiple applications of the concentrated wash fluid, as may be suitable or desired for a given configuration of the dishwasher 10.

As shown in FIG. 2, the sump 52 is located underneath the wash area 90 and adjacent to the back wall 38 of the tub 12. A portion of the bottom wall 40 adjacent to the sump 52 may be designed to direct liquid into the sump 52 as described above. The close proximity of the sump 52 to the wash area 90 and the sprayer 56 increases the likelihood that much of the concentrated wash fluid will be directed back into the sump 52 after its application to the wash area 90 by the sprayer 56. The concentrated wash fluid is thereby made available for re-use in a subsequent washing period. Also, the close proximity of the sump 52 to the sprayer 56 and the wash area 90 reduces the distance required to be traveled by the circulating or recirculating wash fluid, thereby reducing the amount of fluid required to serve the wash area 90.

The pump assembly 62 and electronic control unit 78, along with the associated valves, wiring and plumbing, are located below the tub 12 in a machine compartment 32. The machine compartment 32 is sealed from the tub 12 in that water does not enter the machine compartment 32 during wash cycles.

The sumps 50, 52 may be connected to each other underneath the tub 12 (i.e., in the machine compartment 32) by a communication chamber 96 and a valve 98. The communication chamber 96 can be open or closed, depending upon the position of the valve 98. If the valve 98 is closed, then the sumps 50, 52 work independently of each other. If the valve 98 is open, then fluid can be passed from the sump 50 to the sump 52 and vice versa. The valve 98 may have additional positions that allow fluid to flow through the communication chamber 96 in only one direction at a time (e.g., from sump 50 to sump 52 or vice versa).

The communication chamber 96 is a supply tube, made of polypropylene, for example. The valve 98 is a straight-through valve, such as an electronically-controlled (e.g. solenoid) on-off valve. The electronic control unit 78 sends signals to the valve 98 to control its position.

FIG. 3 illustrates one embodiment of the pump assembly 62, in which the sumps 50, 52 each have a separate, independently controlled fluid delivery system. In this embodiment, the pump 66 is configured to circulate a larger, less concentrated volume of wash fluid while the pump 68 is configured to circulate a smaller, more highly concentrated volume of wash fluid. In this way, a higher wash chemistry concentration can be maintained in the sump 52 without dilution from the other fluid delivery system.

In the embodiment of FIG. 3, each of the pumps 66, 68 is driven by a separate motor 72, 74. The motors 72, 74 are controlled by the electronic control unit 78. However, the need for an additional pump and motor may be avoided by using energy generated by a rotating spray arm to direct the concentrated wash fluid to the wash area 90. An example of such an arrangement is shown and described in U.S. Pat. No. 7,475,696 to Vanderroest et al.

Figure 4:
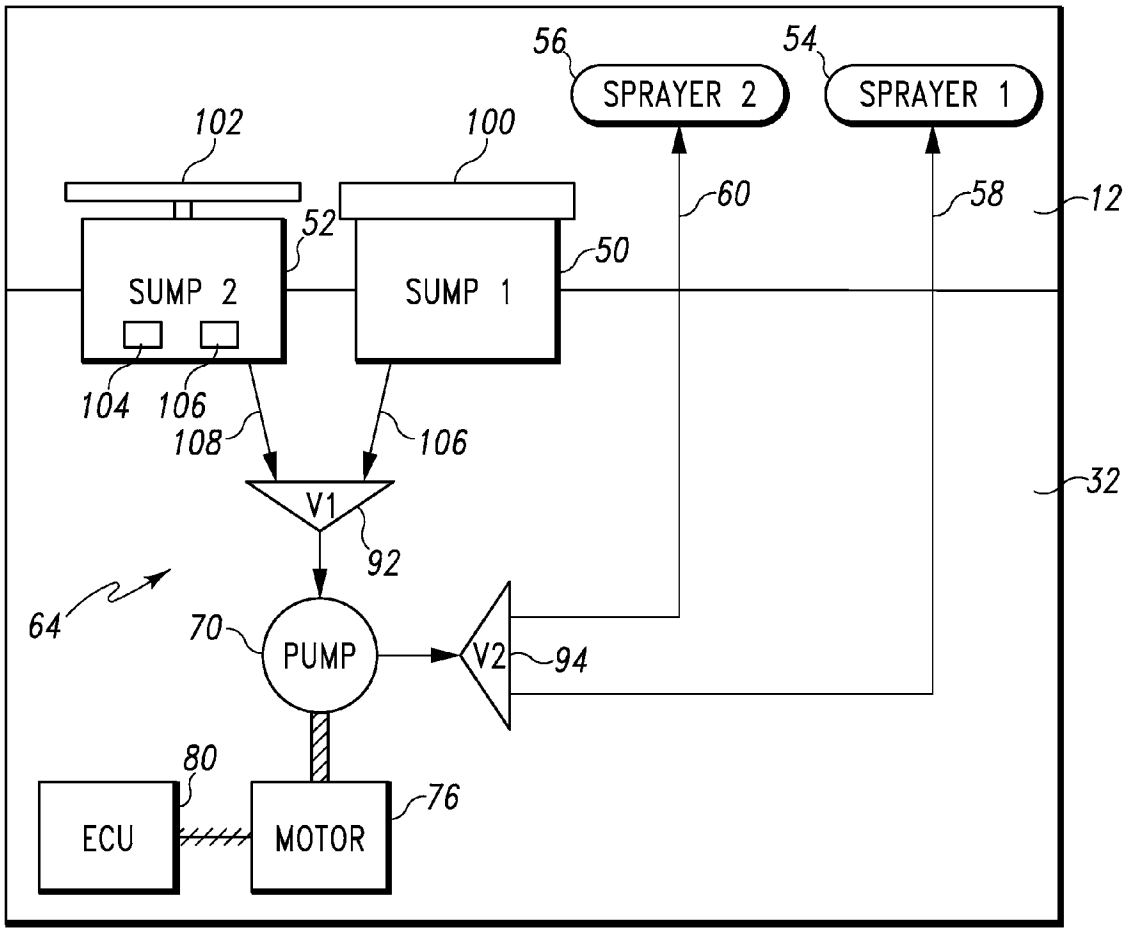
FIG. 4 is a schematic showing components of another embodiment of a sump assembly for the dishwasher of FIG. 1.

An embodiment of a pump assembly 64 is shown schematically in FIG. 4. The pump assembly 64 is similar to the pump assembly 62, except that one pump 70 is driven by a motor 76 in response to control signals received by the motor 76 from an electronic control unit 80. In this embodiment, the pump 70 is shared by the two sumps 50, 52. A valve 92 selectively couples the drain passages 106, 108 of the sumps 50, 52, respectively, to the pump 70. The valve 92 is a two-position electronically (e.g. on/off solenoid) controlled Y-valve. The position of the valve 92 is controlled by the electronic control unit 80.

As illustrated, fluid from only one of the sumps 50, 52 is pumped out to the spray system at any given time. However, the valve 92 may be configured to assume intermediate positions (e.g. controlled by a variable-bleed solenoid), in which case fluid from both of the sumps 50, 52 is mixed according to a specified mixing ratio, which is programmed into the electronic control unit 80.

A valve 94 controls the destination of the fluid output by the pump 70. Depending on the position of the valve 94, fluid is directed to the sprayer 54 only, to the sprayer 56 only, or to both of the sprayers 54, 56. The valve 94 may be a diverter valve, rotating selector disk, or similar mechanism as will be understood by those skilled in the art.

As illustrated in FIG. 4, the sumps 50, 52 are covered by a lid 100, 102, respectively. When the lids are closed, the lids 100, 102 prevent fluid in the tub 12 from entering the sumps 50, 52. In other words, there are no openings in either of the lids 100, 102 that would permit fluid to enter the sumps 50, 52 from the tub 12 when the lids 100, 102 are closed. Opening and closing of the lids 100, 102 is controlled by the electronic control unit 80 actuating a spring-loaded solenoid valve or similar expandable and contractable mechanism coupled to each lid 100, 102. According to the requirements of a specific design, the lids 100, 102 are operable by the electronic control unit 80 to be simultaneously open, simultaneously closed, or open while the other lid is closed. The lids 100, 102 are thus controllable to allow the sumps 50, 52 to collect water at the same time or independently of each other. For example, the electronic control unit 80 may keep the lid 102 closed while the sump 50 fills with water, and then open the lid 102 to allow the sump 52 to receive water to create the concentrated wash fluid. In FIG. 4, the lid 100 is shown in a closed position and the lid 102 is shown in an open position. Although not shown in the drawing, it is contemplated that the lids 100, 102 may be used in the embodiment of FIG. 3 and other embodiments, as well, and that the lids 100, 102 may be omitted from the embodiment of FIG. 4.

One or a number of sensors 104 may be integrated into the sump 52 to detect changes in the water level or the wash chemistry concentration, to detect a malfunction in the sump 52, or to obtain other information from the sump 52. The sensor output is transmitted to the electronic control unit 78, 80, 108. Computer logic at the electronic control unit 78, 80, 108 determines whether a response is required and if so, initiates the appropriate action in response to the sensor output. For example, if the sensor 104 detects a low chemistry concentration in the sump 52, the electronic control unit 78, 80, 108 may activate an LED or other visual indication to alert the user that chemistry needs to be added to the sump 52.

As another example, the sensor 104 may be a temperature sensor that measures the temperature of fluid in the sump 52. The electronic control unit 78, 80, 108 may be configured to control the valving 96, 112 based on temperature readings from the sensor 104. Alternatively or in addition, a temperature sensor may be positioned in the sump 50. In this way, the flow of fluid into the sump 52 may be controlled based on the temperature of the fluid in either the sump 50 or the sump 52. For example, fluid may be retained in the sump 50 or in the fluid supply 110 until it reaches a desired temperature (e.g. 70 degrees Fahrenheit or more). Once the fluid reaches the desired temperature, the electronic control unit 78, 80, 108 controls the valving 96, 112 to open the fluid flow into the sump 52.

In some embodiments, the electronic control unit 78, 80, 108 may include a timer (not shown). The timer may be used to coordinate dispensing of fluid from the sumps 50, 52. For example, dispensing of fluid from the sump 50 may be delayed relative to dispensing of fluid from the second sump 52, or vice versa. The delay may occur within the cycle or within a cycle element (e.g., wash, rinse, dry). The delay time may be in the range of about 5-30 minutes within a cycle element.

Also, the order of dispensing fluid from the sumps 50, 52 may be interchanged (e.g. dispensing from the sump 52, then dispensing from the second sump 50), based on the chemistry of the fluid in one or both of the sumps 50, 52 or another condition.

One or more chemical activation devices 106 may be provided in the sump 52. The device or devices 106 may be used to activate or aid the activation of chemistry in the sump 52. Such chemical activation devices 106 may include a source of ultraviolet radiation, electrolysis, heat, or other type of electromagnetic radiation, or a chemical catalyst, for example.

Figure 5:
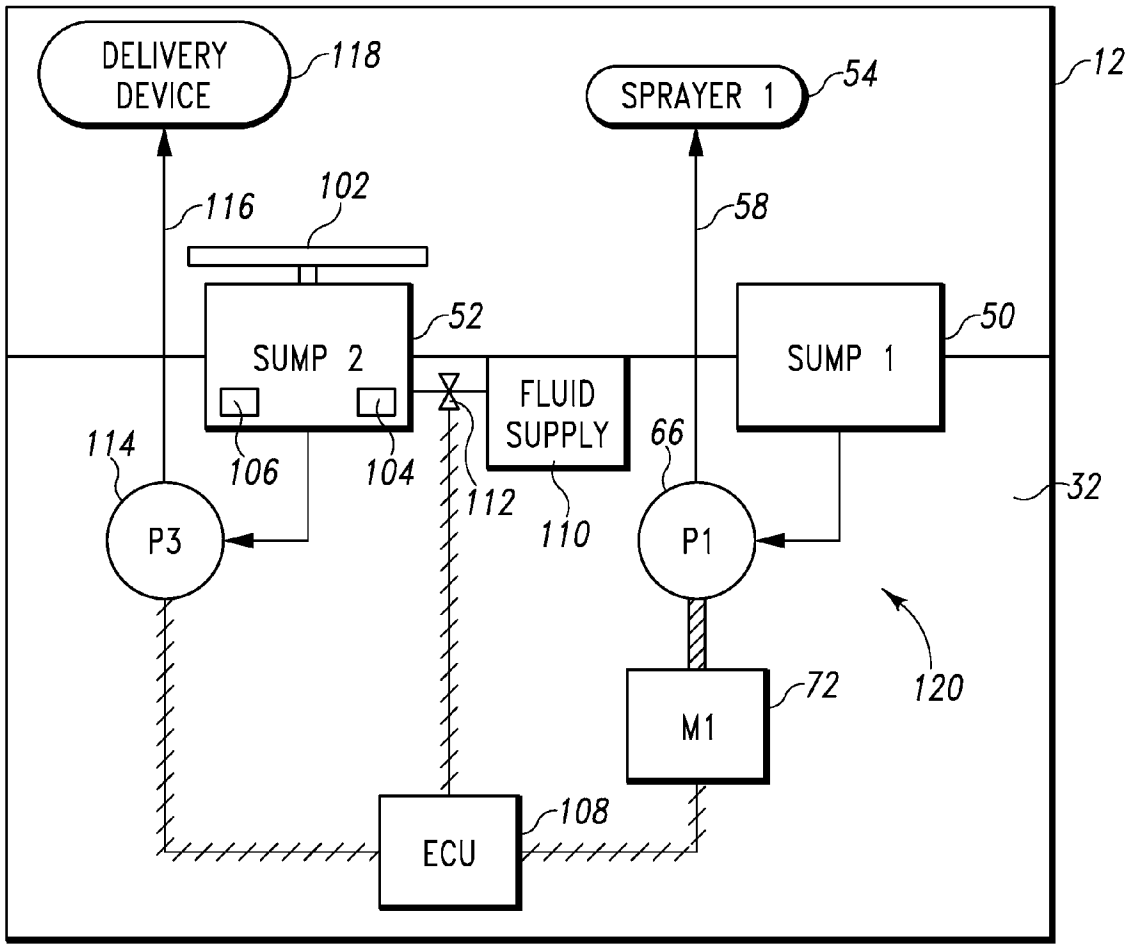
FIG. 5 is a schematic showing components of yet another embodiment of a sump assembly for the dishwasher of FIG. 1.

FIG. 5 illustrates a pump assembly 120, which is configured for more controlled delivery of wash chemistry to the sump 52. The pump assembly 120 is similar to the pump assembly 62 shown in FIG. 3 and described above. However, in the pump assembly 120, a fluid supply 110 is coupled to the sump 52 by a fluid conduit and valving 112. The fluid supply 110, and the fluid conduit and valving 112, may be located in the machine compartment 32, as shown in FIG. 5, or elsewhere in the dishwasher 10 (e.g. in the door 24 or one of the side walls 36.

The fluid supply 110 retains a wash chemistry in an enclosed compartment. The wash chemistry is directed into the sump 52 at the appropriate time during a wash cycle by the fluid conduit and valving 112. The selective opening and closing of the valving 112 may be electronically controlled, e.g. by the control unit 78, as shown in FIG. 5, or by other means.

Fluid entering the sump 52 from the fluid supply 110 may be mixed with water and/or other substances in the sump 52 to create a wash chemistry mixture. For example, if the lid 102 is open, fluid entering the sump 52 from the fluid supply 110 may be mixed with water that enters the tub 12 via the inlet 48 and drains into the sump 52. Alternatively, if the lid 102 is closed, fluid from the fluid supply 110 may remain isolated from liquid and/or other substances in the tub 12, and be routed in its original form directly to the delivery device 118 (e.g. by a pump 114 and conduit 116 as shown in FIG. 5). The lid 102 may be selectively opened and closed by the control unit 108. Also, or alternatively, in the pump assembly 120, the sump 52 may be connected with the sump 50 by a communication chamber 96 and valve 98, as described above. Thus, a number of possibilities exist for creating a wash fluid in the sump 52 that includes a mixture of substances or a desired concentration of wash chemistry.

The fluid delivery device 118 may be a conventional or a specially-configured spray device, but may also take the form of a foamer, mister, steamer, venturi, nebulizer, fan, injector, or other suitable device for directing wash fluid into the tub 12 or a portion thereof. Likewise, the pump 114 may be an air pump or other suitable mechanism for directing wash fluid from the sump 52 to the fluid delivery device 118. In some embodiments, the pump 114 may be eliminated entirely. For example, if the wash chemistry includes a gas, such as carbon dioxide, the force provided by the release of the gas into the sump 52 may be sufficient to direct the wash fluid to the fluid delivery device 118. As such, the fluid supply 110 may include a tank, cartridge, cylinder or other source of a gaseous fluid, such as carbon dioxide. As another example, heating the wash fluid in the sump 52 (e.g. by the chemical activation device 106) may be used to convert the wash fluid to a mist or vapor that flows through the delivery device 188.

A variety of different types and forms of chemistry may be used to create the wash fluid that is retained in the sump 52. As noted above, the chemistry may take the form of a liquid or non-liquid substance. The chemistry may initially be in the form of a solid (e.g. powder, crystals, or tablets) that dissolves or otherwise changes state in the sump 52.

Elements such as the valves 92, 94, 112, lids 100, 102, sensors 104, and activation devices 106, are generally in electrical communication with the electronic control unit (e.g., 78, 80, 108); however, electrical communication links are omitted from the drawings for clarity.

As will be understood by those skilled in the art, the electronic control units 78, 80, 108 include analog and/or digital circuitry to process electrical signals received from components of the dishwasher 10 and provide electrical control signals to components of the dishwasher 10. For example, the electronic control units 78, 80, 108 may comprise one or more microcontrollers that execute firmware routines to control the operation of the dishwasher 10.

There are many advantages of the present disclosure arising from the various features described herein. It will be noted that alternative embodiments of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing method performed by a dishwashing machine, comprising:

directing fluid into a first sump located in a bottom wall of a tub of the dishwashing machine, creating a wash fluid having a wash chemistry in the first sump, directing the wash fluid from the first sump to a first spray device located in the tub during a wash cycle, directing a second volume of fluid into a second sump located in the bottom wall of the tub and opening into the tub at a position spaced from the first sump, creating a concentrated wash fluid in the second sump, the concentrated wash fluid having a higher wash chemistry concentration than the wash fluid from the first sump, and directing the concentrated wash fluid to a second spray device located in the tub during the wash cycle.

2. The method of claim 1, comprising recirculating the concentrated wash fluid to the second spray device.

3. The method of claim 1, comprising directing the wash fluid from the first sump to the first spray device and directing the concentrated wash fluid from the second sump to the second spray device during a pre-treating or post-treating phase of the wash cycle.

4. The method of claim 1, comprising selectively directing fluid from one of the first and second sumps to the other of the first and second sumps through a communication chamber located underneath the tub.

5. The method of claim 1, comprising closing a lid to cover the second sump.

6. The method of claim 1, comprising sensing the concentration of wash chemistry in the second sump and sending an output signal indicative of the sensed wash chemistry concentration to an electronic control unit of the dishwashing machine.

7. The method of claim 1, comprising activating an indicator on the dishwashing machine during the step of creating a concentrated wash fluid in the second sump.

8. A dishwashing method performed by a dishwashing machine, comprising:

directing a first volume of fluid into a first sump located in a bottom wall of a tub of the dishwashing machine, directing wash fluid from the first sump to a first fluid delivery device located in the tub, directing a second volume of fluid into a second sump located in the bottom wall of the tub and spaced from the first sump, receiving fluid from the first sump into the second sump, creating a concentrated wash fluid in the second sump, the concentrated wash fluid having a higher wash chemistry concentration than the wash fluid in the first sump, and directing the concentrated wash fluid to a second fluid delivery device.

9. The method of claim 8, comprising activating a wash chemistry activation device located in the second sump.

10. The method of claim 8, comprising receiving fluid from a fluid supply located outside the tub into the second sump.

11. The method of claim 8, comprising releasing a gas into the second sump.

12. The method of claim 8, comprising activating an indicator on the dishwashing machine, wherein the indicator indicates a status of the second sump.

13. The method of claim 8, comprising directing by the second fluid delivery device the concentrated wash fluid to a wash area in the tub.

14. The method of claim 13, comprising activating at least one of a foamer, nebulizer, fan, sprayer, mister, and injector.

15. The method of claim 8, comprising opening a lid of the second sump.

16. The method of claim 8, wherein comprising selectively opening and closing by an electronic control unit a lid of the second sump.

17. The method of claim 8, comprising selectively opening and closing a valve coupled to the second sump.

18. The method of claim 8, comprising sensing the concentration of wash chemistry in the second sump and sending an output signal indicative of the sensed wash chemistry concentration to an electronic control unit of the dishwashing machine.

19. A method of performing a wash cycle in a dishwashing machine including a tub defining a wash chamber comprising:

introducing a fluid into the tub, with a first portion of the fluid flowing into a first wash sump located in a bottom wall of the tub at a first position within the wash chamber and a second portion of the fluid flowing into a second wash sump located in the bottom wall of the tub at a second position which is spaced from the first position within the wash chamber;

mixing the first portion of the fluid with a wash chemistry in the first wash sump to establish a first wash fluid having a first wash chemistry;

mixing the second portion of the fluid with a wash chemistry in the second wash sump to establish a second wash fluid having a second wash chemistry, wherein the second wash fluid has a higher wash chemistry concentration than the first wash fluid;

directing the first wash fluid to a first spray device located in the tub during a portion of the wash cycle; and directing the second wash fluid to a second spray device located in the tub during another portion of the wash cycle, wherein the first and second wash fluids from the first and second wash sumps combine to cleanse dishware placed in the wash chamber for the wash cycle.

20. The method of claim 19, comprising receiving fluid from the first sump into the second sump.

* * * * *